US009160057B2

(12) United States Patent
Chen et al.

(10) Patent No.: US 9,160,057 B2
(45) Date of Patent: Oct. 13, 2015

(54) UNSYMMETRICAL DIPOLE ANTENNA

(75) Inventors: I-Shan Chen, Hsinchu (TW); Jia-Fong Wu, Hsinchu (TW); Chia-Hong Lin, Hsinchu (TW); Cheng-Hsiung Hsu, Hsinchu (TW); Chao-Chun Lin, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 286 days.

(21) Appl. No.: 13/304,698

(22) Filed: Nov. 28, 2011

(65) Prior Publication Data

US 2013/0027266 A1 Jan. 31, 2013

(30) Foreign Application Priority Data

Jul. 29, 2011 (TW) ..... 100126987 A

(51) Int. Cl.

| | |
|---|---|
| ***H01Q 9/16*** | (2006.01) |
| ***H01Q 1/24*** | (2006.01) |
| ***H01Q 9/26*** | (2006.01) |
| ***H01Q 5/357*** | (2015.01) |

(52) U.S. Cl.
CPC ..... *H01Q 1/243* (2013.01); *H01Q 5/357* (2015.01); *H01Q 9/26* (2013.01)

(58) Field of Classification Search
CPC ..... H01Q 9/16
USPC ..... 343/793
See application file for complete search history.

(56) References Cited

U.S. PATENT DOCUMENTS

| | | | | |
|---|---|---|---|---|
| 4,719,471 | A * | 1/1988 | Killingsworth | 343/792 |
| 6,239,765 | B1 * | 5/2001 | Johnson et al. | 343/795 |
| 6,836,250 | B2 * | 12/2004 | Dai et al. | 343/700 MS |
| 6,853,338 | B2 * | 2/2005 | McConnell | 343/702 |
| 2006/0125697 | A1 * | 6/2006 | Hung et al. | 343/700 MS |

FOREIGN PATENT DOCUMENTS

| | | |
|---|---|---|
| CN | 101364664 B | 4/2012 |
| TW | 200701560 | 1/2007 |

* cited by examiner

*Primary Examiner* — Dameon E Levi
*Assistant Examiner* — Andrea Lindgren Baltzell
(74) *Attorney, Agent, or Firm* — Winston Hsu; Scott Margo

(57) ABSTRACT

An unsymmetrical dipole antenna includes a grounding element, a radiating element, and a feed-in wire. The grounding element includes a first short side metal plane and a first long side metal plane. The radiating element includes a second short side metal plane and a second long side metal plane. The feed-in wire includes a metal wire, coupled to the second short side metal plane for transmitting a feed-in signal; an insulation layer, covering the metal wire; a metal weave, covering the insulation layer, having one terminal coupled to the first short side metal plane of the grounding element, and another terminal coupled to a system ground of the wireless communication device; and a protective layer, covering the metal weave. A size of the grounding element and a size of the radiating element are irrelative.

9 Claims, 9 Drawing Sheets

UNSYMMETRICAL DIPOLE ANTENNA

BACKGROUND OF THE INVENTION

1. Field of the Invention

The present invention relates to an unsymmetrical dipole antenna, and more particularly, to an unsymmetrical dipole antenna for wideband or multi-frequency applications, capable of adjusting appearance while meeting a product structure.

2. Description of the Prior Art

Antennas are utilized for emitting or receiving radio waves, to transmit or exchange radio signals. An electronic product with wireless communication function, e.g. notebook computer, personal digital assistant, etc., generally utilizes a built-in antenna to access a wireless network. Therefore, to facilitate a user's access to the wireless communication network, an ideal antenna should maximize its bandwidth within a permitted range, while minimizing physical dimensions to accommodate the trend for smaller-sized portable wireless communication devices, and integrating the antennas into the portable wireless communication devices. Additionally, with the advance of wireless communication technology, operating frequencies of different wireless communication systems may be different. Therefore, the ideal antenna should be able to cover the required bands of different wireless communication networks via a single radiator.

In the prior art, one of common wireless communication antennas is planar inverted-F antenna (PIFA). As implied in the name, a shape of PIFA is similar to an inverted and rotated "F". In general, a basic structure of PIFA includes a radiating element and a metal plane with a large area to form a "ground", thereby wasting a lot of areas. Furthermore, PIFA radiating element requires a long length for a low frequency application (e.g. 800 MHz), causing large area and high cost, which is not suitable for a compact mobile device.

Therefore, it is a common goal in the industry to effectively increase the bandwidth of antennas, as well as meet the space constraints of the compact mobile devices.

SUMMARY OF THE INVENTION

It is therefore an objective of the present invention to provide an unsymmetrical dipole antenna.

The present invention discloses an unsymmetrical dipole antenna for a wireless communication device. The unsymmetrical dipole antenna includes a grounding element, a radiating element, and a feed-in wire. The grounding element includes a first short side metal plane, extending toward a first direction; and a first long side metal plane, coupled to the first short side metal plane, and extending toward a second direction substantially perpendicular to the first direction. The radiating element includes a second short side metal plane, separating from the first short side metal plane by a first distance, and extending toward an opposite direction of the first direction; and a second long side metal plane, coupled to the second short side metal plane, and extending toward the second direction. The feed-in wire includes a metal wire, coupled to the second short side metal plane of the radiating element, for transmitting a feed-in signal; an insulation layer, covering the metal wire; a metal weave, covering the insulation layer, having one terminal coupled to the first short side metal plane of the grounding element, and another terminal coupled to a system ground of the wireless communication device; and a protective layer, covering the metal weave. Wherein a size of the grounding element and a size of the radiating element are irrelative.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
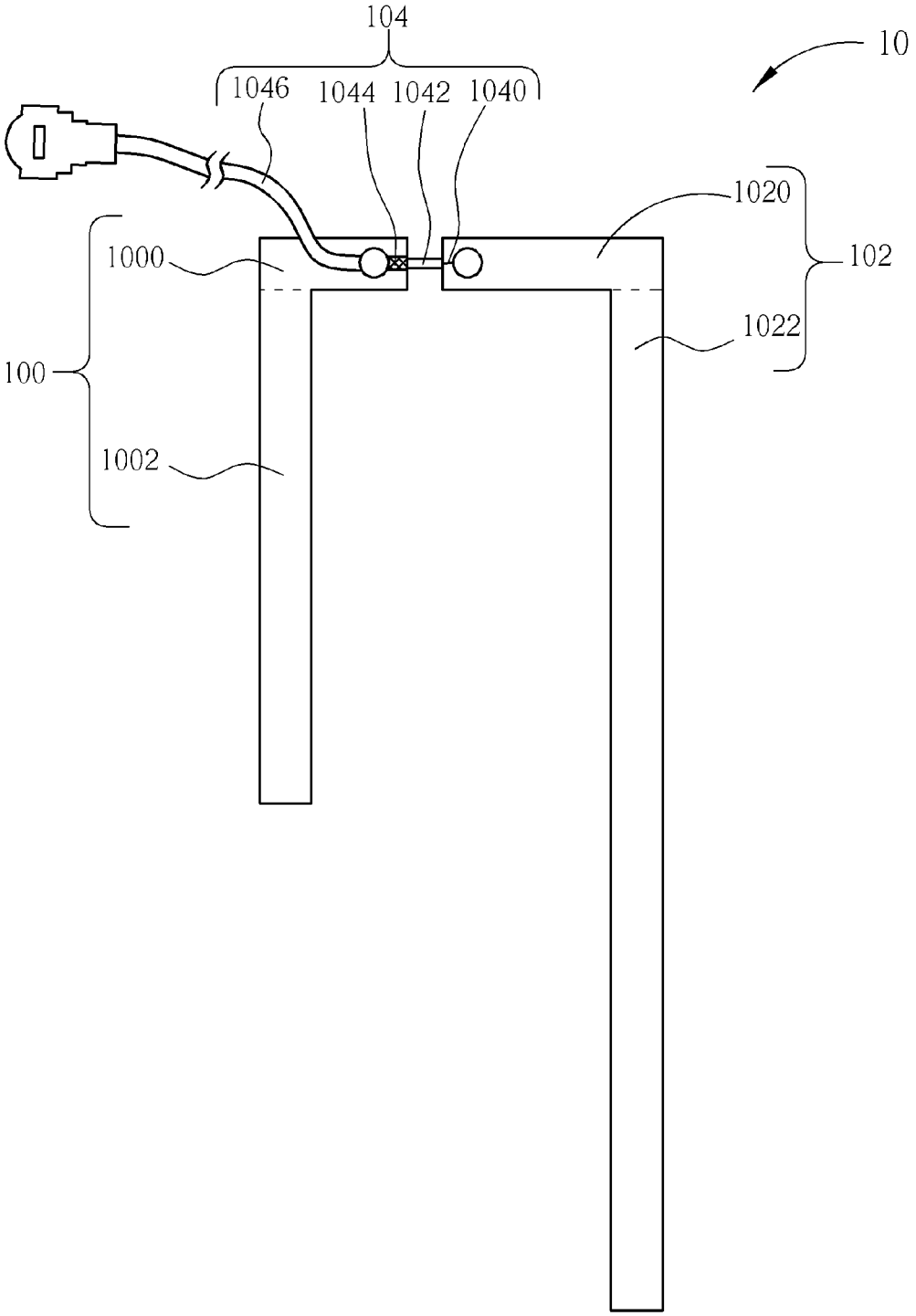
FIG. 1A is a schematic diagram of an unsymmetrical dipole antenna according to an embodiment of the present invention.

Please refer to FIG. 1A, which is a schematic diagram of an unsymmetrical dipole antenna 10 according to an embodiment of the present invention. The unsymmetrical dipole antenna 10 can be utilized for various wireless communication devices, such as a smart phone, a global positioning system (GPS) receiver, etc. The unsymmetrical dipole antenna 10 includes a grounding element 100, a radiating element 102, and a feed-in wire 104. The grounding element 100 is composed of a short side metal plane 1000 and a long side metal plane 1002, which are mutually perpendicular. A structure of the radiating element 102 is similar to that of the grounding element 100, and the radiating element 102 is composed of a short side metal plane 1020 and a long side metal plane 1022, which are mutually perpendicular. A total length of the short side metal plane 1020 and the long side metal plane 1022 is substantially equal to a quarter of a wavelength of a signal to be transmitted or received (i.e. a feed-in signal). Besides, as shown in FIG. 1A, a size of the grounding element 100 and a size of the radiating element 102 are irrelative or different. In other words, the grounding element 100 and the radiating element 102 are unsymmetrical dipole structures.

Figure 1B:
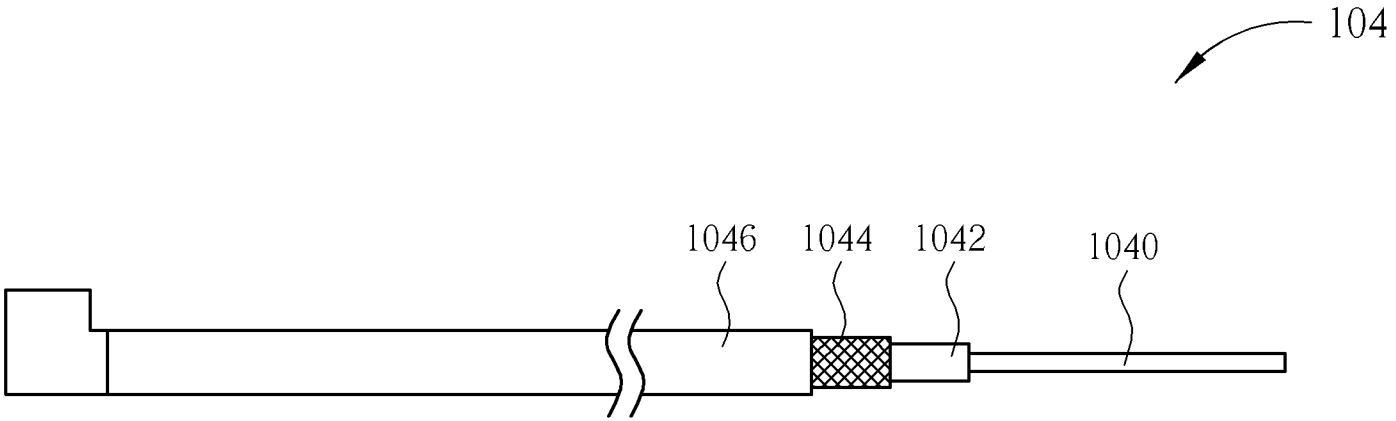
FIG. 1B is a detailed structure diagram of a feed-in wire shown in FIG. 1A.

Please simultaneously refer to FIG. 1B, which is a schematic diagram of a detailed structure of the feed-in wire 104. The feed-in wire 104 is a common coaxial transmission line, and includes a metal wire 1040, an insulation layer 1042, a metal weave 1044, and a protective layer 1046 from inside to outside. The metal wire 1040 is utilized for transmitting the feed-in signal, and coupled to the short side metal plane 1020. The insulation layer 1042 covers the metal wire 1040, for isolating the metal wire 1040 from the metal weave 1044. The metal weave 1044 has one terminal coupled to the short side metal plane 1000, and another terminal coupled to a system ground of the wireless communication device. Finally, the protective layer 1046 covers the metal weave 1044, for protecting the feed-in wire 104. Therefore, the grounding element 100 connects to the system ground via the metal weave 1044 of the feed-in wire 104, and does not directly connect to the ground as shown in the prior art.

Note that, FIG. 1A is utilized for illustrating the structure of the unsymmetrical dipole antenna 10, and those skilled in the art may make alterations or modifications accordingly, which is not limited thereto. For example, in FIG. 1A, the grounding element 100 and the radiating element 102 are inverted-L (s) opposite to each other, and the sizes of the grounding element 100 and the radiating element 102 are unequal, thus forming the unsymmetrical dipole structure. However, other embodiments can be derived, as long as a total length of the short side metal plane 1020 and the long side metal plane 1022 is at least equal to a quarter of the wavelength of the signal to be transmitted or received. For example, materials and widths of the grounding element 100 and the radiating element 102, distance between the grounding element 100 and the radiating element 102, etc. can be properly adjusted. Lengths of the short side metal planes 1000/1020 and the long side metal planes 1002/1022, the total lengths and included angles of the short side metal planes 1000/1020 and the long side metal planes 1002/1022, etc. can also be adjusted for different requirements. Materials of the grounding element 100 and the radiating element 102 are not limited, e.g. the grounding element 100 and the radiating element 102 can be a conductive coating material formed on a substrate via coating, printing, laser engraving technique, etching or evaporation deposition; or, the grounding element 100 and the radiating element 102 can be formed on a surface of a product housing and isolated with paint or glue coating. Similarly, a length, a material, etc. of the feed-in wire 104 are not limited to a specific standard.

Figure 1C:
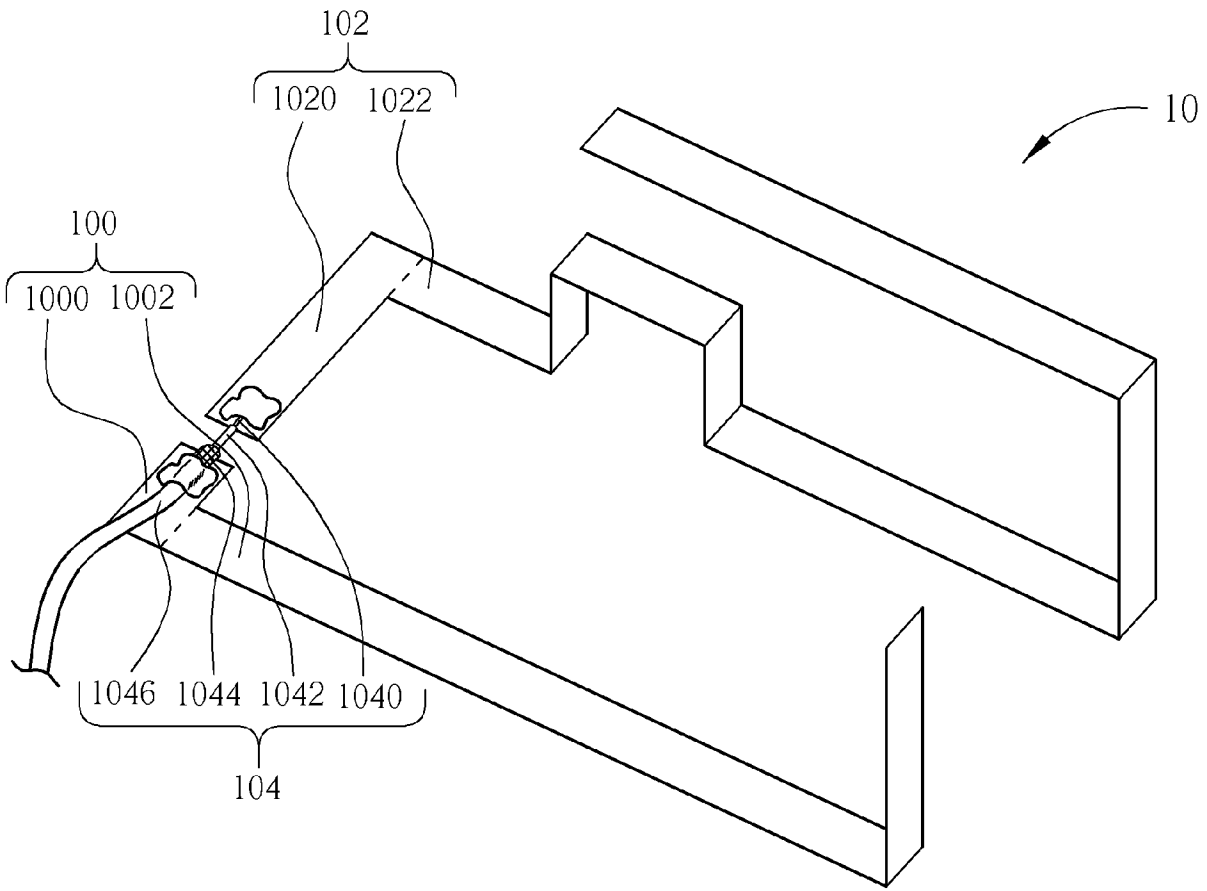
FIG. 1*c* is a schematic diagram of the unsymmetrical dipole antenna shown in FIG. 1A after properly bent according to an embodiment of the present invention.

In addition, the short side metal planes 1000/1020 or the long side metal planes 1002/1022 are not limited to be formed on a plane, and may include multiple bends to be three-dimensional. For example, please refer to FIG. 1C, which is a schematic diagram of the unsymmetrical dipole antenna 10 shown in FIG. 1A after properly bent according to an embodiment of the present invention. As shown in FIG. 1C, the long side metal plane 1002 includes a geometric shape of "L" after being bent, the long side metal plane 1022 includes geometric shapes of "Π" (or doorframe) and "L" after being bent, in order to maintain a total length of the long side metal planes 1002 and 1022, and meanwhile, reduce the lengths of the long side metal planes 1002 and 1022 on the horizontal. In other words, projection areas of the long side metal planes 1002 and 1022 corresponding to an expanded plane can be effectively reduced, to facilitate product application.

Figure 2A:
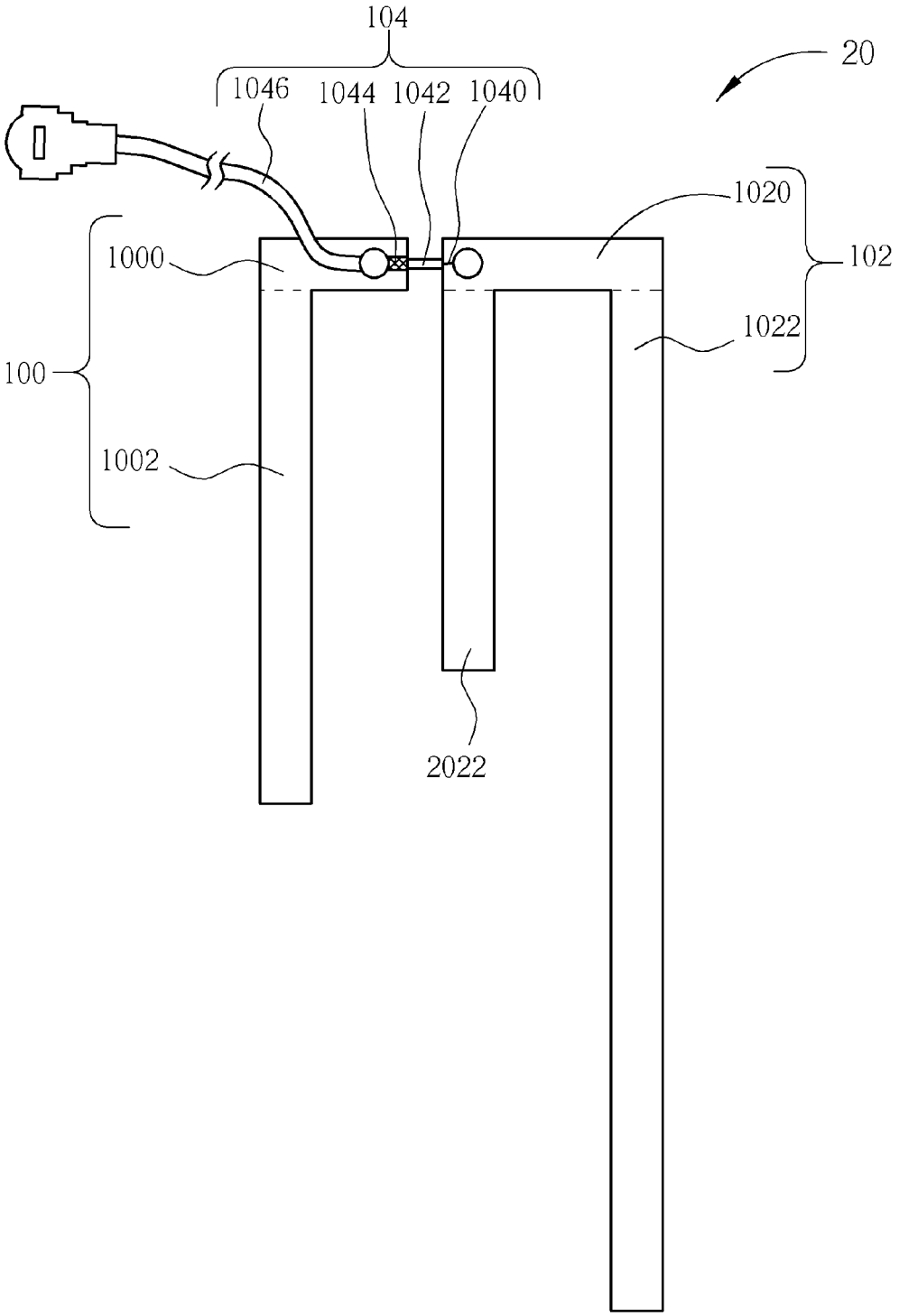
FIG. 2A is a schematic diagram of an unsymmetrical dipole antenna according to an embodiment of the present invention.
Figure 2B:
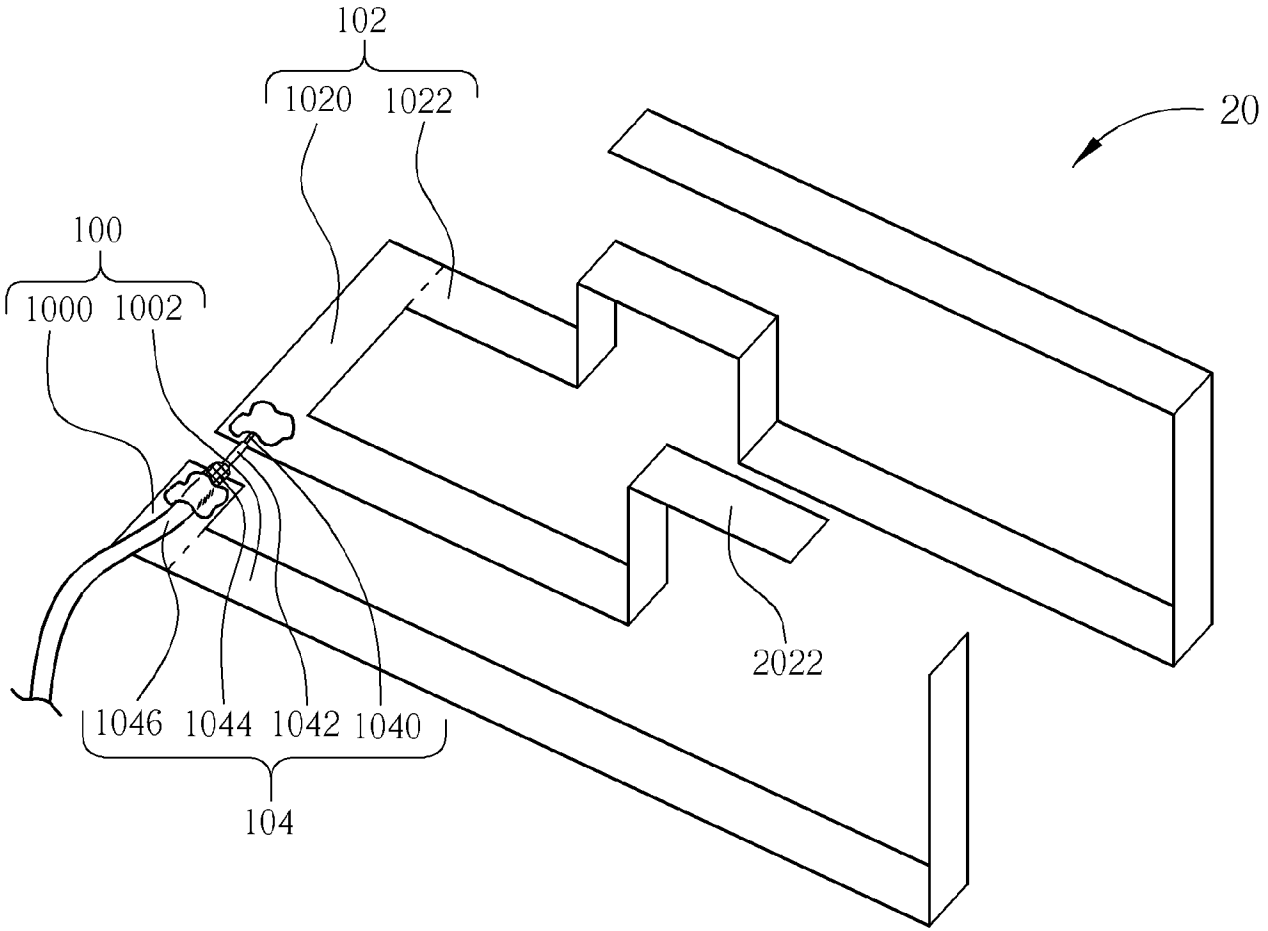
FIG. 2B is a schematic diagram of the unsymmetrical dipole antenna shown in FIG. 2A after properly bent according to an embodiment of the present invention.

Besides, additional radiating paths can be further added to the radiating element 102. For example, please refer to FIG. 2A, which is a schematic diagram of an unsymmetrical dipole antenna 20 according to an embodiment of the present invention. A structure of the unsymmetrical dipole antenna 20 is similar to that of the unsymmetrical dipole antenna 10, and the same components are denoted by the same symbols for simplicity. The difference between the unsymmetrical dipole antenna 20 and the unsymmetrical dipole antenna 10 is that the unsymmetrical dipole antenna 20 further includes a long side metal plane 2022 in comparison with the unsymmetrical dipole antenna 10. The long side metal plane 2022 is coupled to the short side metal plane 1020, and perpendicular to the short side metal plane 1020. The long side metal plane 2022 forms an additional current path to provide an additional operating frequency band for the unsymmetrical dipole antenna 20. Similarly, as shown in FIG. 2B, the unsymmetrical dipole antenna 20 can be properly bent to reduce a projection area of the unsymmetrical dipole antenna 20 corresponding to an expanded plane.

Figure 3A:
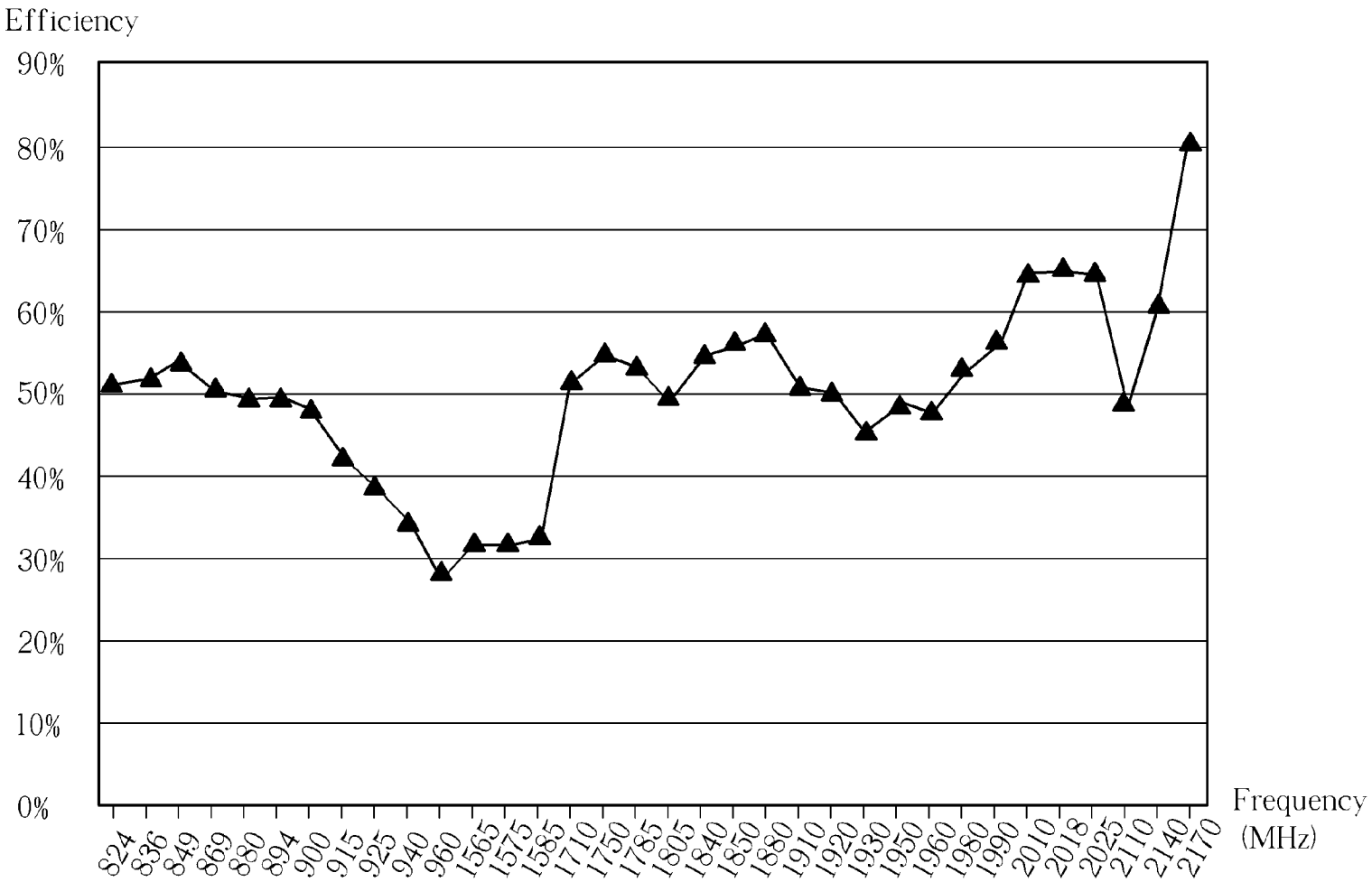
FIG. 3A is a schematic diagram of radiation efficiency of the unsymmetrical dipole antenna shown in FIG. 2A applied to the third generation (3G) mobile communication system and the second generation (2G) mobile communication system.
Figure 3B:
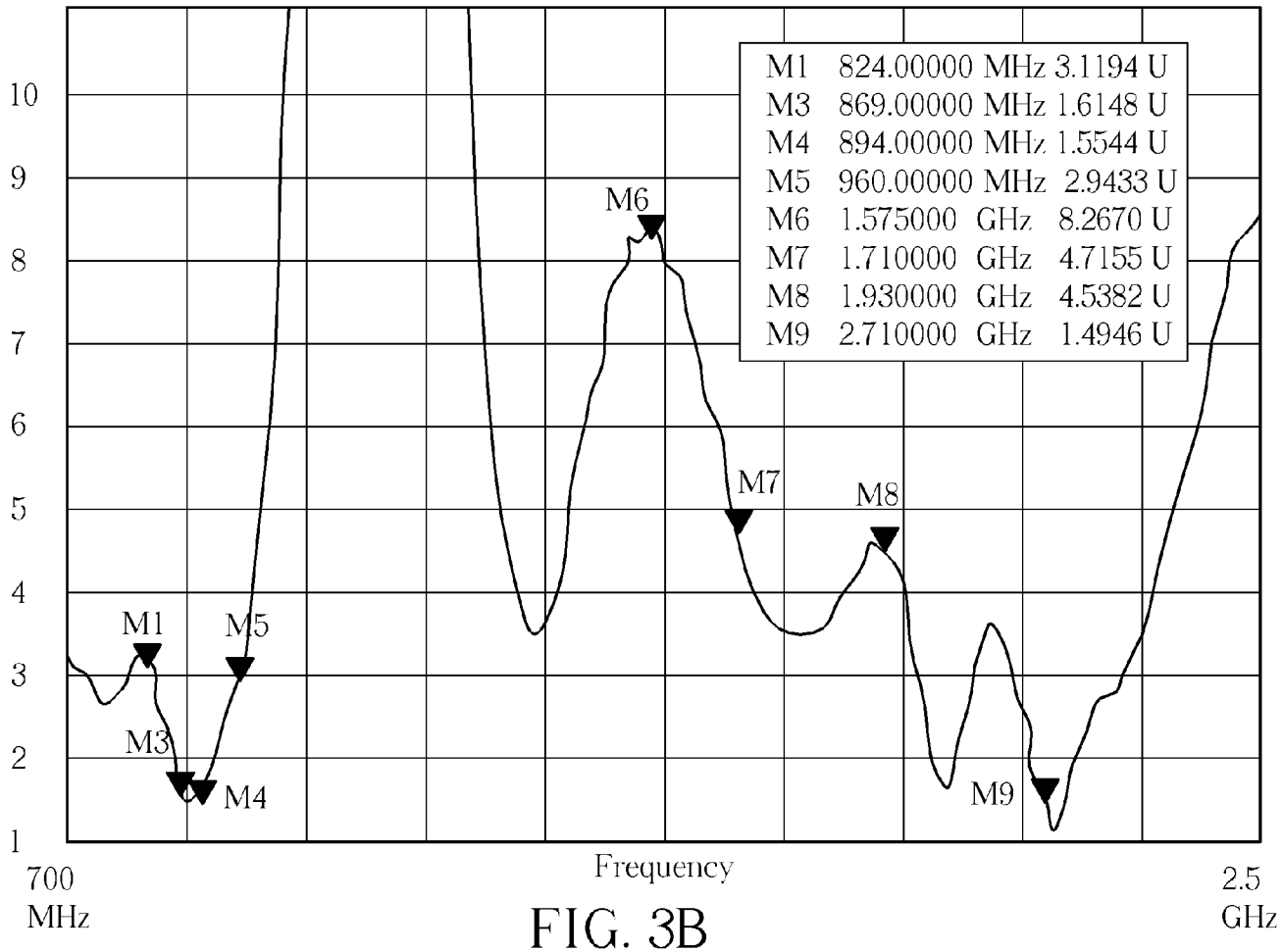
FIG. 3B is a schematic diagram of voltage standing wave ratio (VSWR) of the unsymmetrical dipole antenna shown in FIG. 2A applied to the 3G mobile communication system and the 2G mobile communication system.
Figure 4:
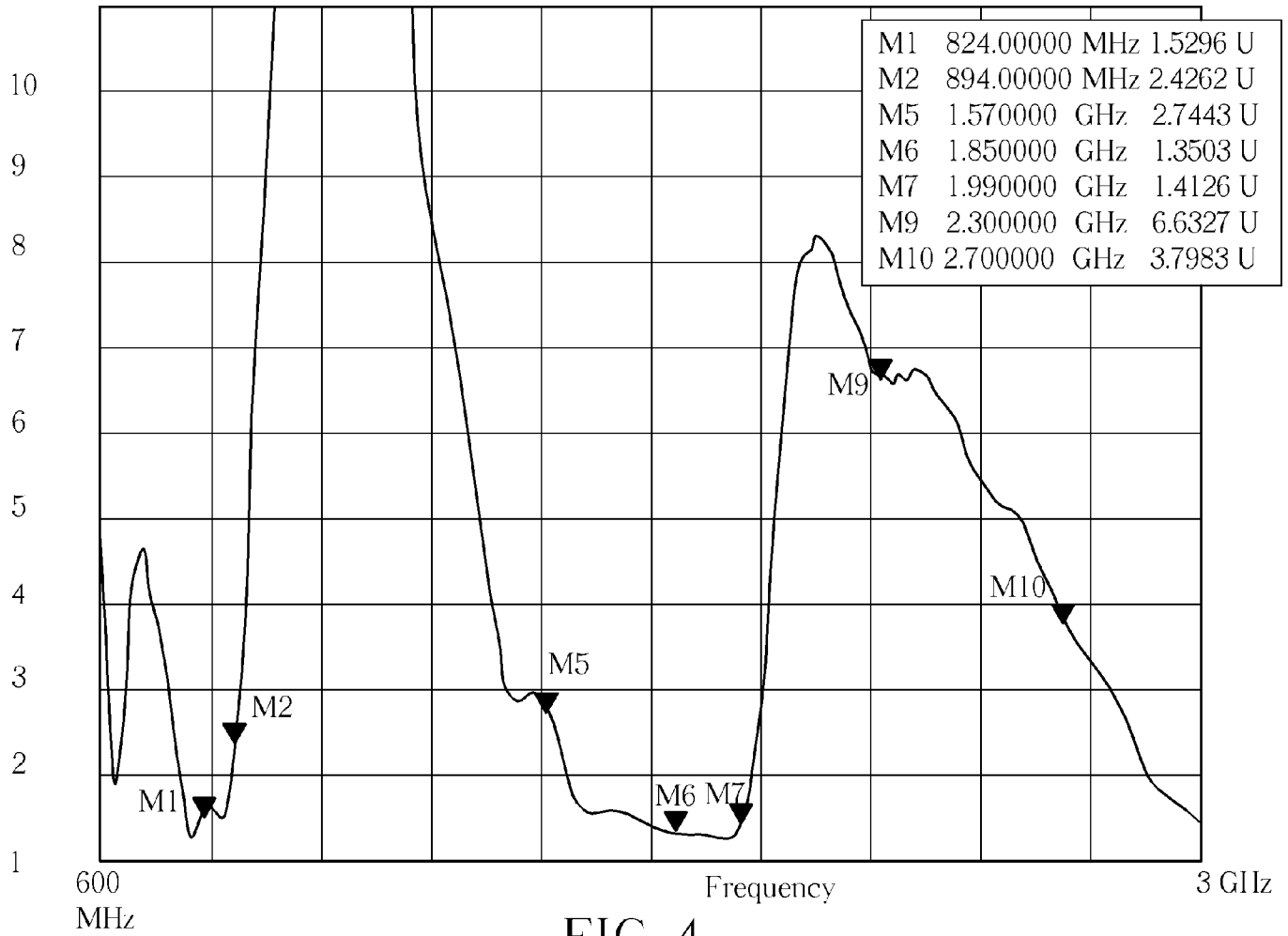
FIG. 4 is a schematic diagram of VSWR of the unsymmetrical dipole antenna shown in FIG. 2A applied to the 3G mobile communication system and the global positioning system (GPS).

Comparing to the unsymmetrical dipole antenna 10, the unsymmetrical dipole antenna 20 includes an additional operating frequency band. Therefore, after properly adjusting the lengths of the long side metal planes 1022 and 2022, the unsymmetrical dipole antenna 20 can be applied to different wireless communication systems. For example, for the third generation (3G) mobile communication system and the second generation (2G) mobile communication system, the lengths of the long side metal planes 1022 and 2022 can be properly adjusted to obtain schematic diagrams of radiation efficiency shown in FIG. 3A and voltage standing wave ratio (VSWR) shown in FIG. 3B. Similarly, for the 3G mobile communication system and the global positioning system (GPS), the lengths of the long side metal planes 1022 and 2022 can be properly adjusted to obtain a schematic diagram of VSWR shown in FIG. 4.

Figure 5:
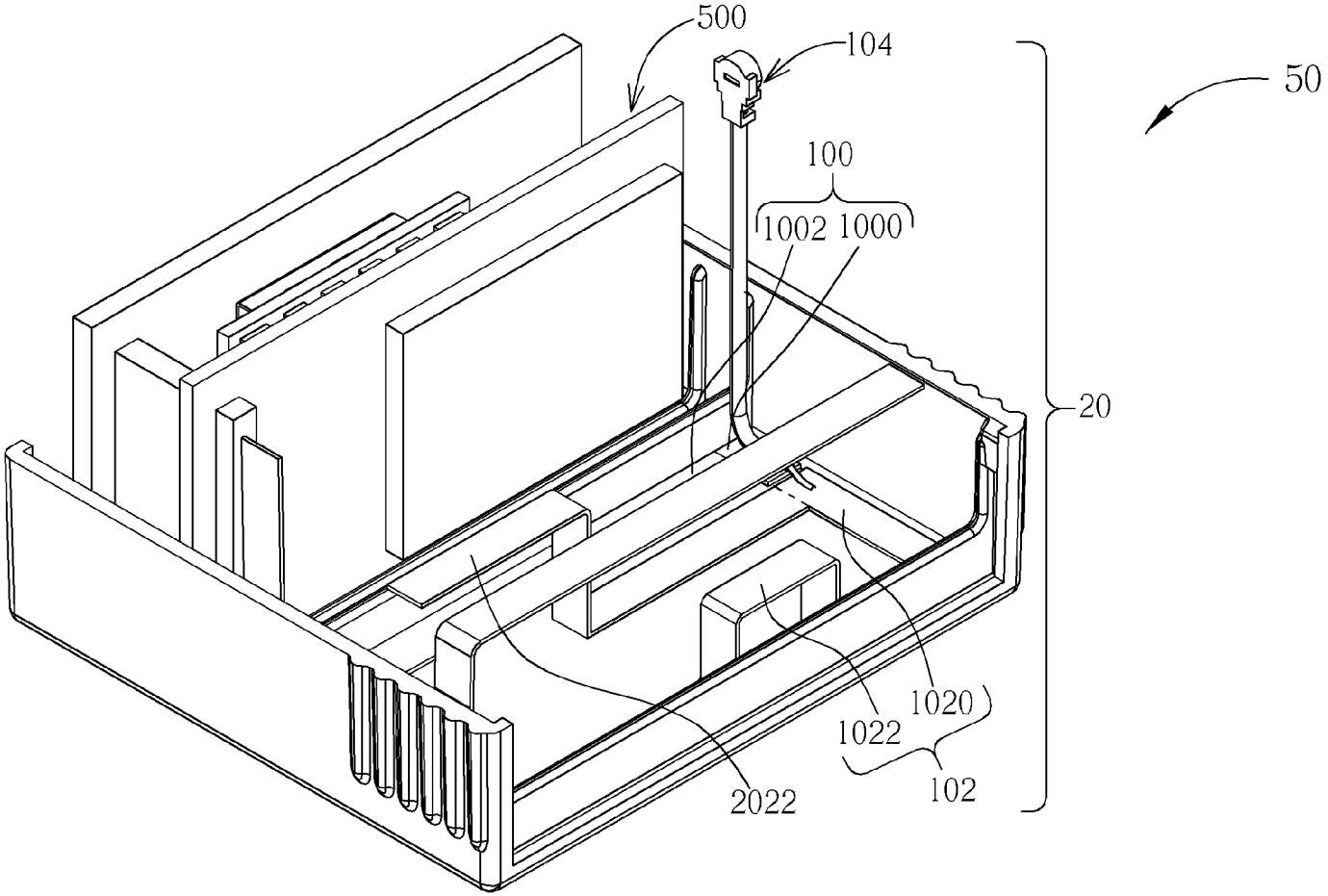
FIG. 5 is a schematic diagram of a wireless communication device according to an embodiment of the present invention.

On the other hand, as to assembling of the unsymmetrical dipole antenna 10 or the unsymmetrical dipole antenna 20, a printed circuit board can be utilized to provide reflection effect, to enhance antenna efficiency. For example, FIG. 5 is a schematic diagram of a wireless communication device 50 according to an embodiment of the present invention. The wireless communication device 50 is equipped with the unsymmetrical dipole antenna 20, and a printed circuit board 500 of the wireless communication device 50 is formed adjacent to the grounding element 100 and perpendicular to the grounding element 100. Metal wires, chips, etc. disposed on the printed circuit board 500 can provide additional reflection effect, to enhance radiation efficiency of the unsymmetrical dipole antenna 20.

In the prior art, PIFA radiating element requires a long length for a low frequency application (e.g. 800 MHz), causing large area and high cost, and PIFA needs a metal plane of large area to provide grounding. In comparison, the grounding element 100 of the present invention is small, and the grounding element 100 and the radiating element 102 can be bent to conform to the housing design, to facilitate the product application.

To sum up, the unsymmetrical dipole antenna of the present invention is suitable for wideband or multi-frequency applications, and the appearance thereof can be adjusted to meet a product housing, which benefits the space utilization of compact mobile devices.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An unsymmetrical dipole antenna for a wireless communication device, comprising:

a feed terminal;

a ground terminal;

a grounding element, comprising:

a first short side metal plane, directly coupled to the ground terminal and extending from the ground terminal toward a first direction; and a first long side metal plane, coupled to the first short side metal plane, and extending from a first connection point with the first short side metal plane toward a second direction substantially perpendicular to the first direction;

a radiating element, comprising:

a second short side metal plane, directly coupled to the feed terminal, separating from the first short side metal plane by a first distance, and extending from the feed terminal toward an opposite direction of the first direction; and a second long side metal plane, coupled to the second short side metal plane, and extending from a second connection point with the second short side metal plane toward the second direction; and a feed-in wire, comprising:

a metal wire, coupled to the second short side metal plane of the radiating element via the feed terminal, for transmitting a feed-in signal;

an insulation layer, covering the metal wire;

a metal weave, covering the insulation layer, having one terminal coupled to the first short side metal plane of the grounding element via the ground terminal and another terminal coupled to a system ground of the wireless communication device; and a protective layer, covering the metal weave;

wherein the grounding element and the radiating element form an unsymmetrical dipole structure;

wherein a length of the first short side metal plane and a length of the second short side metal plane are unequal, and a length of the first long side metal plane and a length of the second long side metal plane are unequal;

wherein a total length of the first short side metal plane and the first long side metal plane and a total length of the second short side metal plane and the second long side metal plane are unequal.

2. The unsymmetrical dipole antenna of claim 1, wherein a total length of the second short side metal plane and the second long side metal plane is substantially equal to a quarter of a wavelength of the feed-in signal.

3. The unsymmetrical dipole antenna of claim 1, wherein the second long side metal plane comprises a plurality of bends, for reducing a projection area of the second long side metal plane corresponding to an expanded plane, and the plurality of bends form at least one geometric shape.

4. The unsymmetrical dipole antenna of claim 3, wherein a geometric shape of the at least one geometric shape substantially conforms to Π.

5. The unsymmetrical dipole antenna of claim 3, wherein a geometric shape of the at least one geometric shape substantially conforms to L.

6. The unsymmetrical dipole antenna of claim 3, wherein a geometric shape of the at least one geometric shape substantially conforms to an arc.

7. The unsymmetrical dipole antenna of claim 1, wherein the radiating element further comprises a third long side metal plane, coupled to the second short side metal plane, and extending toward the second direction.

8. The unsymmetrical dipole antenna of claim 1, wherein the second long side metal plane separates from the first long side metal plane by a second distance greater than the first distance.

9. The unsymmetrical dipole antenna of claim 1, wherein the first long side metal plane comprises at least one bend, for reducing a projection area of the first long side metal plane corresponding to an expanded plane.

* * * * *